United States Patent [19]

Zimmer

[11] Patent Number: 4,940,013

[45] Date of Patent: Jul. 10, 1990

[54] APPARATUS FOR COATING FABRIC WEBS

[76] Inventor: Johannes Zimmer, Ebentalerstrasse 133, A-9020 Klagenfurt, Austria

[21] Appl. No.: 243,551

[22] PCT Filed: Nov. 18, 1987

[86] PCT No.: PCT/AT87/00068

§ 371 Date: Sep. 2, 1988

§ 102(e) Date: Sep. 2, 1988

[87] PCT Pub. No.: WO88/03845

PCT Pub. Date: Jun. 2, 1988

[30] Foreign Application Priority Data

Nov. 18, 1986 [AT] Austria ..... A3066/86
Nov. 18, 1986 [AT] Austria ..... A3070/86

[51] Int. Cl.[5] ..... B05C 11/02

[52] U.S. Cl. ..... 118/62; 118/56; 118/121; 118/122; 118/123

[58] Field of Search ..... 118/57, 118, 123, 126, 118/620, 639, 413, 419, 56, 163, 121, 122, 623, 47, 369

[56] References Cited

U.S. PATENT DOCUMENTS

| | | | |
|---|---|---|---|
| 3,335,701 | 8/1967 | Verkinderen et al. | 118/126 |
| 3,518,109 | 6/1970 | Halley | 118/639 |
| 3,897,578 | 7/1975 | Kanda et al. | 118/126 |
| 3,939,799 | 2/1976 | Kanbara | 118/620 |
| 4,655,166 | 4/1987 | Nishimura et al. | 118/419 |

*Primary Examiner*—Willard Hoag
*Attorney, Agent, or Firm*—Wenderoth, Lind & Ponack

[57] ABSTRACT

Disclosed is an apparatus for use in coating and possibly impregnating fabric webs with a coating compound. The apparatus utilizes a magnetic element or cylinder, located on a first side of a fabric web, to attract a magnetically attractable squeegee device, located on a second side of the fabric web, into contact with the fabric web. A second squeegee device or a cylinder is mounted against the magnetic eleemtn and is also located on the first side of the fabric web. This second squeegee device is also located such that when the first squeegee device is attracted toward and contacts the fabric web, the fabric web comes into contact with the second squeegee device, thus providing that the fabric web will be contacted on both sides with equal pressure by the respective squeegee devices.

12 Claims, 3 Drawing Sheets

APPARATUS FOR COATING FABRIC WEBS

BACKGROUND OF THE INVENTION

The invention concerns an apparatus for coating of fabric webs which utilizes a magnetic element or a stationary magnetic cylinder, located on one side of the fabric web, to magnetically attract an application device, located on the opposite side of the fabric web, into contact with the fabric web.

According to No. AT-A-289 158, when a magnetic beam is used for causing a squeegee-type coating application device to press against a web of fabric, a support body has generally been provided through the row of electromagnets which make up the magnetic element. The support body has an indentation facing the squeegee-type coating application device and is covered by a metal slide plate. This arrangement, however, acts in a manner similar to a standard air squeegee, in which only the metal slide plate opposes the pressure exerted by the squeegee against the fabric web.

SUMMARY OF THE INVENTION

Various efforts have been made to provide a suitable support for the squeegee body and have included flattening the area which supports or contacts the squeegee, and distributing the forces introduced by the squeegee as evenly as possible over as large a surface as possible. Starting from this premise, it was in no way obvious that it would be possible to use the principle of magnetic pressure in a process for coating both sides of a fabric web by use of a squeegee device. Tests done by the applicant have surprisingly shown that it is possible, according to the invention, to provide a second squeegee device on a side of the fabric web opposing the first squeegee device and a magnetic element or a stationarily arranged magnetic cylinder for attracting the first squeegee device toward the fabric web and toward the second squeegee device.

Although various physical embodiments are contemplated, each embodiment will include a magnetic element (or a magnetic cylinder) for attracting a pressure body, which either itself forms a squeegee device or presses against a squeegee device which applies an almost linear stress to the fabric web. The force which creates the linear stress is opposed by the squeegee device on the same side of the fabric web as the magnetic element. The squeegee device on the same side of the fabric web as the magnetic element can be a flexible metal or plastic blade which, in a known manner rests against the magnetic element, or an element, mounted to the magnetic element, which extends toward the fabric web at an acute angle and contacts the fabric web at a location opposite the location where the opposing, magnetically attracted squeegee device contacts the web.

BRIEF DESCRIPTION OF THE DRAWING FIGURES

Details of the invention are further explained below in connection with the drawing figures, in which.

DETAILED DESCRIPTION OF THE INVENTION

Figure 1:
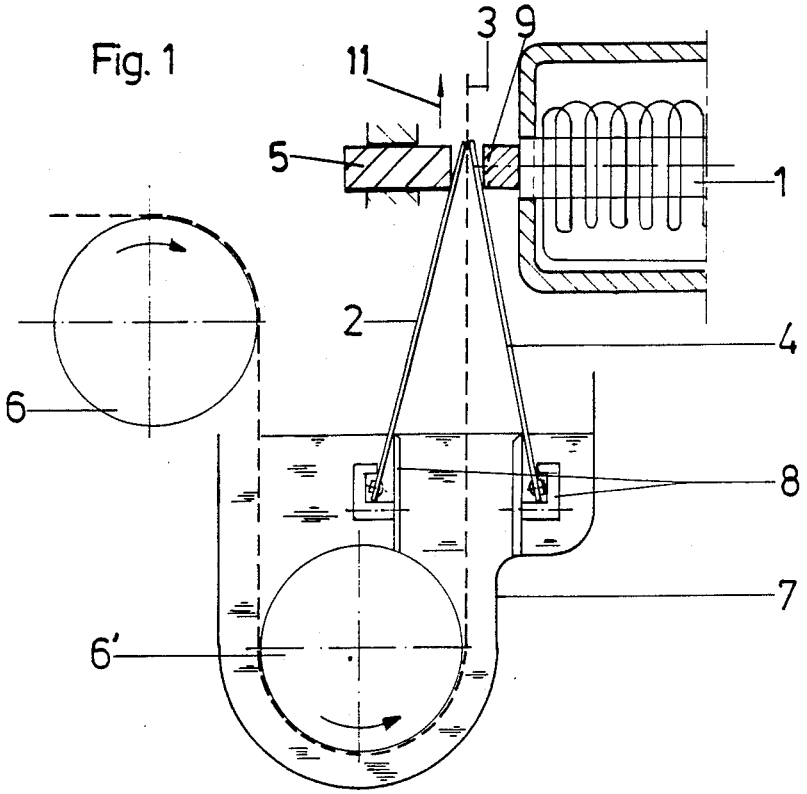
FIG. 1 shows a cross-sectional view of a first embodiment of the present invention.
Figure 2:
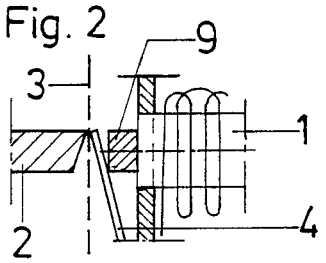
FIG. 2 shows a first variation of the squeegee device shown in FIG. 1.
Figure 3:
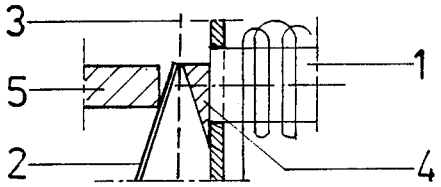
FIG. 3 shows a second variation of the squeegee device.
Figure 4:
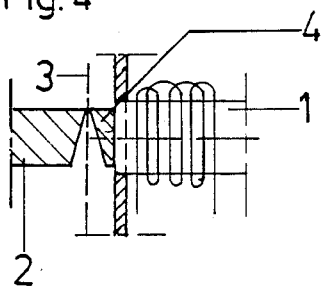
FIG. 4 shows a third variation of the squeegee device.
Figure 5:
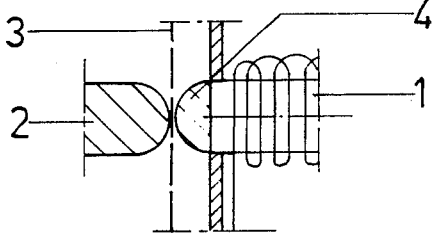
FIG. 5 shows a fourth variation of the squeegee device.

FIG. 1 shows an embodiment of the invention in which the fabric web 3 is disposed vertically and is fed upwardly between two squeegee devices 2 and 4. In this embodiment, the fabric web 3 runs across cylinders 6, 6' and through a trough 7 which contains a compound to be applied to the fabric. As the fabric web is moved through the trough 7, it is covered on both sides with this compound. The arrangement of and pressure exerted on the fabric web by squeegee devices 2 and 4, as the fabric web 3 is moved in the direction of arrow 11 between the squeegee devices, is determinative of the final coating thickness of the compound on the fabric web. In the embodiment of FIG. 1, the squeegee devices 2, 4, are designed as squeegee blades. Furthermore, a magnetic element 1, composed in a known manner of a row of magnets, extends normal to the plane of the drawing and perpendicular to the fabric web 3. This magnetic element 1 can exert a magnetic force to attract a magnetically attractable object 2 acting as one squeegee device and cause it to press the fabric web between it and the other squeegee device 4, as shown in FIGS. 2, 4 and 5. However, it is also quite possible to construct the squeegee device 2 as a flexible metal strip or blade, such as used for screen printing. This arrangement is shown in FIGS. 1 and 3, wherein it is shown that a magnetically attractable pressure body 5 presses against the flexible metal strip 2. Because the squeegee blade 2 is pressed by pressure body 5 at a point close to its free end, the stress exerted on the squeegee holders 8 is very slight and the squeegee holders 8 only have to secure the squeegee devices 2 and 4 against pullout, rather than against a twisting or other force. Contact pressure and contact angle of the squeegee devices 2, 4 with respect to the fabric web determines the immersion depth of compound and the amount of application of compound, respectively. Thus, the degree of coating and the degree of impregnation, can, with such an arrangement, be largely independently controlled.

Devices which utilize magnetic contact pressure to operate squeegees have been previously used in the field of screen printing. In such devices, the squeegee device 2 is pressed against a fabric web 3 which is, in turn, pressed against a flat counter body or, if necessary, by a cylinder with large diameter. However, the subject invention is constructed such that the squeegee device 2 is pressed against the fabric web 3, which is in turn, pressed against a second squeegee device 4 disposed adjacent to the magnetic element 1. This second squeegee device 4 may, as shown in FIGS. 1 and 2, be constructed as a flexible metal sheet, with its free end resting against a support ridge 9, held by the magnetic element 1. However, it is also possible (see FIGS. 3 and 4) to construct the second squeegee 4 as a wedge-shaped element mounted against the magnetic element 1. It is essential in this configuration that the squeegee devices 2 and 4 together form a wedge shaped gap. Such a gap can be attained if both squeegees, for example, are rounded in the contact area, as shown in FIG. 5.

Figure 6:
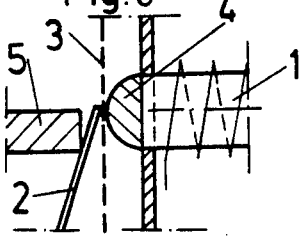
FIG. 6 shows a fifth variation of the squeegee device.
Figure 7:
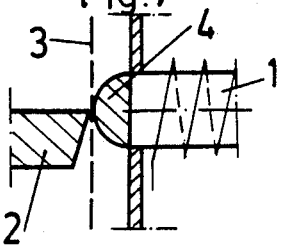
FIG. 7 shows a sixth variation of the squeegee device.

FIGS. 6 and 7 illustrate that the various right and left squeegee devices shown in FIGS. 2 to 5 can be utilized in various combinations. The embodiment shown in FIG. 6 uses a left side squeegee device such as that shown in FIG. 3 and a right side squeegee device such as that shown in FIGS. 5. The embodiment shown in FIG. 7 includes a left side squeegee device such as that shown in FIG. 4 and a right side squeegee device such as that shown in FIG. 5.

Figure 8:
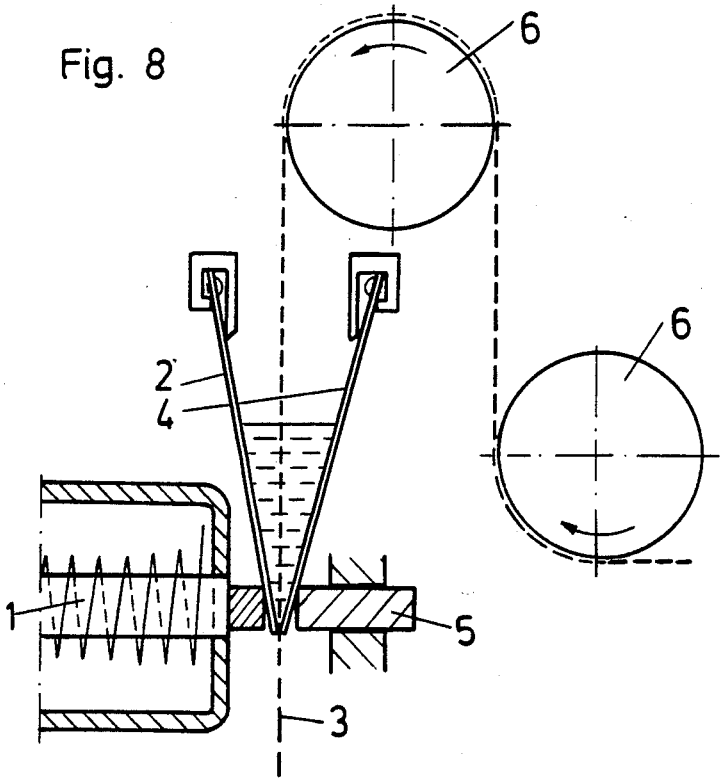
FIG. 8 shows a cross-sectional view of a second embodiment of the present invention.

FIG. 8 shows an apparatus according to the present invention in which the fabric web 3 is fed downwardly rather than upwardly. In this arrangement, the squeegee devices 2 and 4, themselves, form the storage container for the coating substance to be applied to the fabric web 3.

Figure 9:
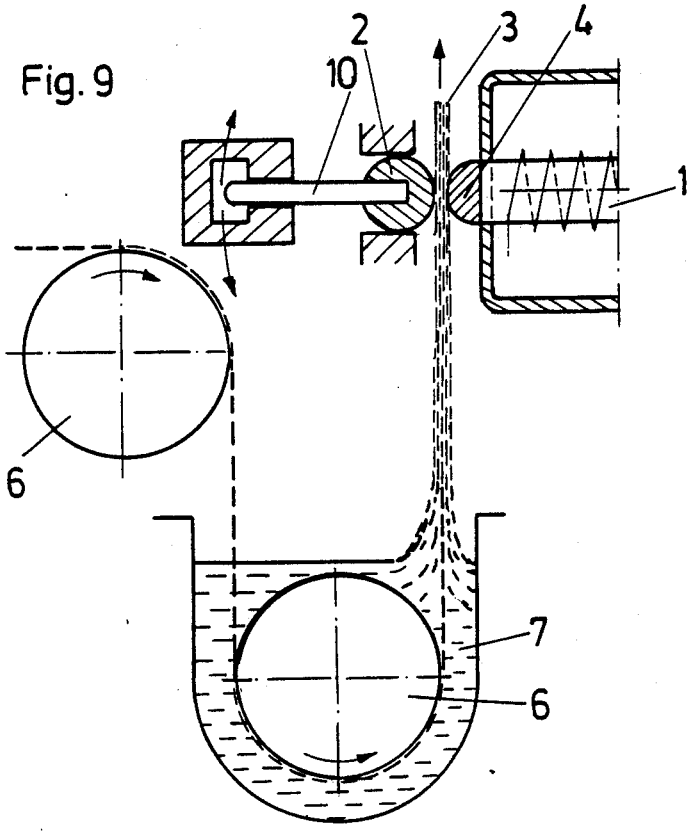
FIG. 9 shows a cross-sectional view of a third embodiment of the present invention.

In the apparatus according to FIG. 9, the squeegee device 2 disposed on the side of the fabric web opposite the magnetic element 1 is constructed as a cylindrical rod mounted on a guide rod 10. By pivoting the guide rod 10 in the direction of the arrows, it is possible to change which portion of the squeegee device 2 contacts the fabric web so as to avoid contacting the fabric web with a surface of the squeegee device which has become worn. Alternatively, it would be possible to attain an even wear of the surface of the rounded contact area of the squeegee device 2 by allowing the cylindrical rod to rotate about an axle. Of course, it would be necessary to have the cylindrical rod rotate at a slow speed, compared to the speed of the web 3 so as to effectively coat and impregnate the web with coating compound 10.

Figure 10:
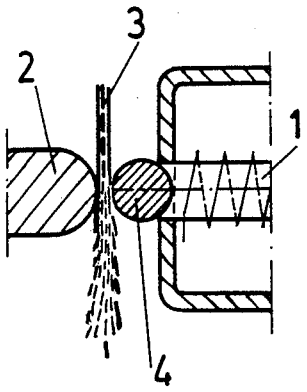
FIG. 10 shows a first variation of the squeegee device shown in FIG. 9.

FIG. 10 shows that the squeegee device 4 can also be formed as a cylindrical rod fixed with respect to the magnetic element 1. Such a squeegee element can, however, be arranged such that its surface moves relative to the fabric web 3.

Figure 11:
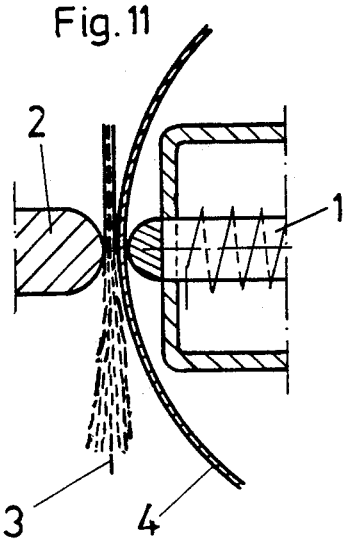
FIG. 11 shows a second variation of the squeegee device shown in FIG. 9.

In FIG. 11 it is shown that the bending radius of the squeegee device 4 (here a cylindrical tube surrounding the magnet 1) can be relatively large, as long as the angle formed between squeegee device 4 and fabric web 3 is sufficiently large that the applied substance is not just smoothed, but is also stripped off by the gliding friction between the web and the squeegee device 4.

The pressing of the second squeegee device 4 against the fabric web 3, as provided by the invention, occurs in all the embodiments by the fact that the magnetic element 1 exerts a magnetic attraction force on the squeegee device 2 which is opposed by the stationary second squeegee device 4. The forces thus exerted by each of the first and second squeegee devices against respective opposite sides of the web are, of course, of the same magnitude. This, however, does not mean that the coatings on the front and back sides of the fabric web 3 are necessarily identical. By selecting different contact angles, as determined by the shape and arrangement of the squeegee devices, the identical force exerted on both sides of the web is distributed over different contact areas, so that different pressure distributions can be produced on each side of the web. Instead of letting the fabric web 3 run through a trough 7, it is also possible to use different arrangements for depositing the coating substance onto the web 3. The coating substance can then be smoothed or stripped by the squeegee devices 2 and 4 in order to attain the desired amount of coating, impregnation and smoothing. It is, of course, also possible to use the present invention for coating a fabric web on only a single side as opposed to coating it on both sides.

I claim:

1. Apparatus for use in coating a fabric web, comprising:

a first squeegee device movably mounted at a location on a first side of a plane;

a second squeegee device located on a second side of said plane opposite said first side; and magnet means for magnetically forcing said first squeegee device toward said second squeegee device, such that when a fabric web with coating compound thereon is fed along said plane, said first and second squeegee devices will contact respective sides of said fabric web and smooth said coating compound therealong.

2. An apparatus as recited in claim 1, wherein said second squeegee device comprises a wedge-shaped element mounted against said magnet means.

3. An apparatus as recited in claim 1, wherein each of said first and second squeegee devices has a contact face for contacting the fabric web; and at least one of said contact faces of said first and second squeegee devices comprises a rounded contact face.

4. An apparatus as recited in claim 1, wherein each of said first and second squeegee devices includes a contact edge for contacting said fabric web; and said contact edge of said first squeegee device is offset along the longitudinal direction of said plane from the contact edge of said second squeegee device.

5. An apparatus as recited is claim 1, wherein said first squeegee device comprises first elongated squeegee blade with a lower end thereof mounted in a first squeegee holder;

said second squeegee device comprises a second elongated squeegee blade with a lower end thereof mounted in a second squeegee holder;

a first magnetically attractable blade contact element is transversely movably mounted to said support frame on a side of said first blade opposite said plain; and a second blade contact element is fixedly mounted against said magnetic means.

6. An apparatus as recited in claim 1, further comprising:

feed means for feeding said fabric web through a supply of said coating compound and along said plane.

7. An apparatus as recited in claim 6, wherein said plane is substantially vertical, and said feed means feeds said fabric web downwardly along said plane.

8. An apparatus as recited in claim 7, further comprising:

a support frame having first and second squeegee holders;

said first squeegee device comprising a first elongated squeegee blade with an end thereof mounted in a first squeegee holder which defines a portion of said support frame;

said second squeegee device comprising a second elongated squeegee blade with an end thereof mounted in a second squeegee holder which defines a portion of said support frame; and said first and second elongated squeegee blades hanging downwardly from said first and second squeegee holders, respectively, upper ends of said first and second squeegee blades being spaced apart and lower ends of said first and second squeegee blades being closely adjacent, such that said first and second blades form a V-shaped trough, said V-shaped trough being adapted to contain said supply of coating compound.

9. An apparatus as recited in claim 1, further comprising a support frame having a squeegee holder;

at least one of said squeegee devices comprising an elongated squeegee blade with one end thereof mounted in said squeegee holder.

10. An apparatus as recited in claim 11, wherein said squeegee blade is securedly but movably mounted within said squeegee holder.

11. An apparatus as recited in claim 9, further comprising a contact means, comprising a blade contact element mounted independently of said squeegee holder, for imparting a force against said squeegee blade which causes said squeegee blade to contact said fabric web as said fabric web passes along said plane.

12. An apparatus as recited in claim 11, wherein said contact element includes a ridge thereon adapted to contact said second squeegee device.

* * * * *